US007316612B2

(12) United States Patent
Odom

(10) Patent No.: US 7,316,612 B2
(45) **Date of Patent: *Jan. 8, 2008**

(54) ELECTRONIC BINGO GAME AND METHOD

(75) Inventor: Wayne Odom, Las Vegas, NV (US)

(73) Assignee: Karaway Gaming, Inc., Tucson, AZ (US)

( * ) Notice: Subject to any disclaimer, the term of this patent is extended or adjusted under 35 U.S.C. 154(b) by 797 days.

This patent is subject to a terminal disclaimer.

(21) Appl. No.: 10/443,567

(22) Filed: May 22, 2003

(65) Prior Publication Data

US 2004/0009806 A1 Jan. 15, 2004

Related U.S. Application Data

(63) Continuation-in-part of application No. 09/557,948, filed on Apr. 24, 2000, now Pat. No. 6,581,935.

(51) Int. Cl.
*A63F 9/24* (2006.01)

(52) U.S. Cl. ..... 463/19

(58) Field of Classification Search ..... 463/19
See application file for complete search history.

(56) References Cited

U.S. PATENT DOCUMENTS 6,581,935 B1 * 6/2003 Odom ..... 273/269

* cited by examiner

*Primary Examiner*—Corbett B. Coburn
(74) *Attorney, Agent, or Firm*—Robert Ryan Morishita; Morishita Law Firm, LLC

(57) ABSTRACT

An electronic Bingo game and method includes a player inputting a wager and displaying a Bingo card in response thereto. A first set of numbers is selected and compared to the numbers of the Bingo card. If a predetermined winning pattern(s) is obtained, the player receives a reward. A second outcome set of numbers is selected. If the player obtains a predetermined winning pattern(s) on the Bingo card from the first and second outcome sets, the player is entitled to a second award. The player can select the numbers for his Bingo card and can make a desired wager up to a preselected maximum wager. The player can have the option to place a second wager prior to selection of the second outcome set. An alternate optional version of the game includes virtual Bingo cards against which the player competes.

36 Claims, 1 Drawing Sheet

ELECTRONIC BINGO GAME AND METHOD

CROSS-REFERENCE TO RELATED APPLICATION

The present application is a continuation-in-part of U.S. patent application Ser. No. 09/557,948 filed Apr. 24, 2000 and titled "Electronic Bingo Game and Method", issued Jun. 24, 2003 as U.S. Pat. No. 6,581,935.

FIELD OF THE INVENTION

The present invention relates to games playing on an electronic device having a display. More particularly it relates to electronic Bingo games and methods.

BACKGROUND

Bingo is a well known game. In its live, non-electronic, form, each player purchases a Bingo card which presents a column/row, five-by-five, matrix. Each column is identified by a letter; B-I-N-G-O and at each coordinate in the matrix a number is provided. Often the center coordinate is marked "Free" rather than having an assigned number. After each player or participant has purchased a card, means are provided to randomly select numbers identified by the column letter and a number, e.g. B15. If a player has, in column B number 15, that coordinate is marked. Typically the universe of letters/numbers is provided on balls which are mixed and serially drawn from a cage or mixer. The selection of balls continues until a player has a card marked (corresponding numbers have been drawn) in a winning pattern. This pattern might be designated before the game as a row, column, corners, and X-pattern of a cover all (all the numbers on the winning card are covered. Thus, to play the game a number of players are required to provide a number of Bingo cards with different numbers so that a single (or few) winners can be declared.

For traditional Bingo, the requirement of having a number of players, perhaps hundreds of players, has frustrated attempts to configure Bingo as a video game which can be played by a single player. Further, Bingo prizes are fixed regardless of the number of players thus failing to provide large and/or progressive jackpots to the winners.

Live Bingo has heretofore been played in, what are known in gaming jurisdictions, as a Class II game. In a Class II game, the awards are typically parimutuel, i.e. paid from the fund created by the aggregated wagers for the game (less an amount permitted to be deducted for hosting the Bingo game) and each game must produce a winning card having a Bingo. That is, balls are drawn until a player, who purchased a Bingo card, has a Bingo. A Bingo, before the game is started, may be defined as a horizontal row, vertical column, diagonal, four corners, coverall or other designated pattern. Large progressive prizes funded by deducting an amount from each game's parimutuel fund, can be offered for a player obtaining a Bingo in a certain, predetermined, minimum number of balls.

Since Bingo is a popular and well-known game, there is a need for an electronic game and method which permits a single player to play Bingo and which is configured to provide large and progressive jackpots.

There is also a need to provide an electronic Bingo game which can be played by a single player but which also qualifies as a Class II game.

Further there is a need for device and method which provides the player with a plurality of chances to win.

Further there is a need for a device and method which provides for the player to optionally double their wager during play in regards to the additional chances to win.

With respect to electronic games using a random number generator to select an outcome, these generators typically operate off of a clock to randomly select a number or groups of numbers to represent an outcome. If the clock is at the same time interval with respect to the random string of numbers, the same outcome will be selected. At least some persons who play gaming machines are award of the operation of random number generators and, from time to time would like to change the clock so that the random number generator (RNG) is at another time thus affecting the outcome randomly selected. Heretofore there has been no means for a player of a game to alter the clock time to change the position of the RNG relative to the field of numbers to be selected from.

Still further there is a need for a device and method which permits the player to wager a desired amount between a pre-selected maximum and minimum amount for each game.

Still further there is a need for a device and method for playing Bingo which permits the player to select their numbers for the Bingo card.

Still further in relation to this game and other electronic games, these is a need to provide means for a player to change the RNG clock to randomly select at a different position in the random string of numbers.

SUMMARY

There is, therefore, set forth according to the present invention, an electronic device and method for playing a Bingo game which includes a data processor and a video display. Means are provided for a player to initiate play of a Bingo game such as by the player inputting a wager and prompting-play. When the game is played, the processor controls the display to display a 5×5 matrix Bingo card and at each of the twenty-five coordinates of the card a discrete indicia selected from a universe of indica. Preferably, the matrix is represented as a well known Bingo card having the columns identified by the letters B-I-N-G-O and the indicia being numbers. Further, the center coordinate may be noted as "Free".

A first data structure or memory stores data corresponding to winning patterns of identified coordinates on said card as well as a corresponding pay table should the player obtain a pattern. These patterns are preferably known BINGO patterns such as a column, row, diagonal or four corners and a coverall.

The processor includes a random number generator driven selection means to select, from the universe of game Bingo numbers, a pre-selected number of Bingo numbers defining a first outcome set and an additional pre-selected number of Bingo numbers to represent a second outcome set. In one embodiment, the first set is 25 numbers, e.g. B12, O63 and the second set may be ten or up to, for example, 28 to 31 additional numbers for a total of 35 to 56 or more numbers depending upon the desired hit frequency is desired and the pays for each predetermined winning pattern. As the numbers are selected, the processor compares each selected Bingo number to the Bingo numbers on the card to determine if there is match or concordance. If so, the location of the concordance is indicated on the display much the same as marking a BINGO card. If the locations marked upon selection of the first outcome set match patterns stored in the data structure, the player receives a first, corresponding pay table award. If all locations are indicated (a BINGO cover all) with both the first and second outcome sets, the player receives a second, cover all, award. Thus the player may win an award based upon obtaining one or more winning patterns from the first outcome set and a higher award based upon selection of the first and second outcome sets, if all the coordinates of the card are marked, e.g. a cover all.

In another embodiment, the player is provided with an option to place a second wager prior to selection of the second outcome set. If the combination of the Bingo numbers selected in the first and second outcome sets produce a predetermined set of designated patterns, the player receives an award based upon the aggregate first and second wagers.

In a further embodiment the player has the option of selecting the indicia for the BINGO card or having it done by the processor.

In still a further embodiment, the player my initiate a re-spin mode which alters the time of the RNG clock.

Also the device and method may provide for control of the display to display the selection of the outcome set indicia and to list the selections.

In a further embodiment, the player selects their Bingo card(s) whereas the computer processor selects a number, e.g. 100, virtual Bingo card against which the player competes. When the first set of balls are selected the processor compares the selected first set to at least the player's card and if the player has one or more predetermined Bingo patterns on their card, they receive an award based upon their first wager. The processor also selects the second set and notes any concordances for the player and virtual Bingo cards. If the player's card(s) have a predetermined pattern(s) as a result of the second selection set, the player receives and award. If the player's card does not have any predetermined pattern but a virtual card does, the processor displays the virtual card for the player to see. In one embodiment, sufficient virtual Bingo cards are created such that it is most likely that the player or a virtual card will produce a winning pattern (a "Bingo"). In another embodiment, in the event there is no Bingo for the player or virtual Bingo cards the player's wager(s) is/are returned to the player. Also, extra balls may be required to be drawn to guarantee a coverall win by one or more of the players.

In this embodiment, the coverall payout will be reduced as a consolation prize. In all cases, the player receives the listed payout regardless of how many virtual players are also won in the game.

According to the foregoing embodiment the player may be afforded the opportunity to make the second wager.

It should be understood that while a processor can be used to draw the numbers, that the numbers could be drawn in a live format as well with an attendant entering data representing the selected numbers for resolution of the game.

Further the game can be played on linked machines as well such as machines linked through a local area network (LAN), a wide area network (WAN) or through the Internet. In such circumstances, for Class II gaming the cards of the linked players may replace the virtual cards.

BRIEF DESCRIPTION OF THE DRAWINGS

These and other features and advantages will become appreciated as the same becomes better understood with reference to the claims, description and drawings wherein:

DESCRIPTION

Figure 1:
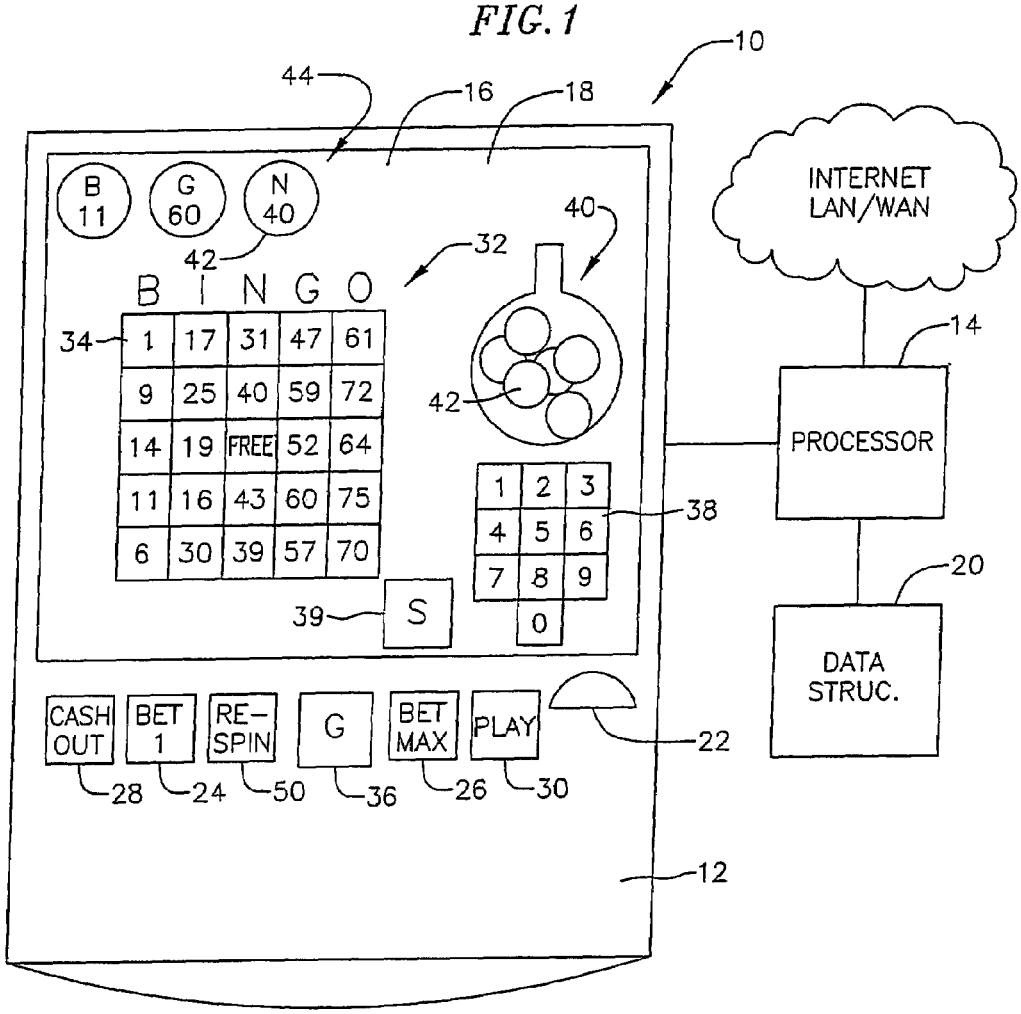
FIG. 1 shows a device for play of the game including a display displays during the play of the game.

Turning to the drawings, FIG. 1 shows a device 10 according to the present invention. The device includes a housing 12 to contain a processor 14 and the components as recited herein including a video display terminal or display 16. The display 16 may be a video terminal or plasma display and may include a touch screen 18 for the player to input selections as hereinafter described.

The processor 14 controls the various features of the device 10 including the display 16. A memory or data structure 20 is provided to store various program, operational and game play data as well as data corresponding to winning BINGO card patterns described below.

With continuing reference to FIG. 1, the device includes means for a player to make a wager. Where the device is operated as a Class II casino gaming device, these means may include a coin slot 22 at which the player inserts coins or tokens to make a wager, a cash validator to receive cash and accumulate credits for wagering in a known manner or means to accept a wager via debit or credit card. Where the device 10 is a novelty game, the means for inputting a wager may include means for wagering fictitious credits or the like. For purposes of the following description, the device 10 is a gaming device of the type provided in casinos.

The waging input means may also include a Bet 1 button 24 by which, in a known manner, the player can wager a single unit or credit and a Bet Max button 26 by which the player may wager the maximum permitted by the device 10. Also provided is a cash out button 28 to enable the player to cash out the accumulated wagering credits from the play of the device 10 and a Play button 30 by which the player prompts the play of the device 10.

The various buttons described above may be embodied as locations on the touch screen 18 and display 16.

To play the game the player first initiates play by making a wager by the wagering means. The wager can be one unit or credit up to a maximum amount permitted by the device 10. The wagering means communicates with the processor 14 to prompt the processor 14 to control the display 16 to display a Bingo card 32. As is known, the card 32 is a 5×5 matrix having five columns and rows, with the columns identified by the letters B-I-N-G-O. The card matrix defines twenty-five coordinate positions 34. At each coordinate position 34 there is provided a discrete indicia shown as a Bingo number. In the preferred embodiment where the universe of Bingo numbers is seventy-five, one-fifth of the numbers is allocated to each column. Thus in column B, each coordinate position 34 can be assigned a number selected from the group of numbers 1-15, for column I numbers 16-30, for column N numbers 31-45, for column G numbers 46-60 and for column O numbers 61-75. When play is initiated, the processor 14 randomly assigns a unique number from the appropriate group to each coordinate position 34. If the player wishes to play the card 32 with the processor assigned numbers, he/she prompts play by depressing the Play button 30.

The center coordinate may be displayed as "free" indicating that that coordinate will always be marked for the game.

If the player wishes the processor 14 to randomly select and position a different set of numbers on the card 32, the player depresses or touches on the touch screen 18 a "Generate" button.

Means are provided for the player to select their own numbers for each coordinate position for the allocated group of numbers. These means may be a keypad 38 displayed on the display 16 at which the player, through the touch screen 18, selects the numbers. Thus the player can select the numbers for the card 32 or can have the processor 14 make the selection. To select their numbers, the player depresses a select button 39 on the device 10 or touch screen 18 and uses the key pad or other suitable input device to select the number for each coordinate 34 position as selected from the allocated groups of numbers for each column as described above.

Once the card 32 has been completed, the player prompts play of the game.

When play is prompted, the processor 14 controls the display 16 to display the selection of a first and second outcome set of numbers randomly selected by a random number generator (RNG) in the processor 14 from the universe set of numbers of B1-15, I16-30, N31-45, N46-60 and O61-75. The processor 14 may control the display 14 to display, during the selection as described above, a hopper or mixing cage 40 mixing balls 42 each bearing a letter/number combination and sequentially issuing a selected ball to be displayed at call board area 44 on the display 14.

The processor 14 controls the selection to select a first outcome set of a pre-selected number of Bingo numbers ("balls"), preferably twenty-five balls 42. As each letter/number ball is selected, the processor 14 compares the selection to the Bingo numbers on the card 32. If a concordance occurs (the letter/number on the ball matches a coordinate location letter/number) the processor controls the display 16 to indicate or mark that coordinate position 34. The marking may be by flashing the coordinate position, displaying it in a different color, by superimposing a mark at the coordinate position 34 or by any other suitable means.

Figure 2:
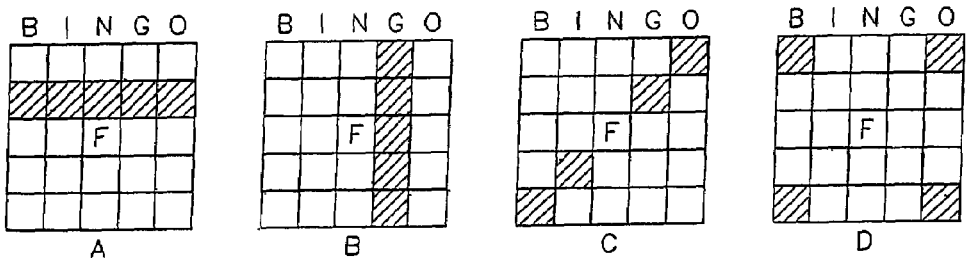
FIG. 2 shows winning patterns.

After the first outcome set of twenty-five numbers has been selected, the processor 14 compares the marked or indicated coordinate 34 positions corresponding to the selection to the winning pattern data stored in the data structure 20. If one or more winning patterns of marked coordinate positions 34 on the card 32 has been obtained, the player is entitled to a reward based upon their wager and the predetermined pay table award for obtaining that particular pattern. With reference to FIG. 2, a group of pre-selected winning Bingo patterns is shown. Pattern A shows a row, pattern B shows a column, pattern C shows a diagonal and pattern D shows four corners. If the marked coordinate positions 34 on the card 32 match one or more of the patterns of FIG. 2 based upon the selection of the first outcome set, the player is entitled to a reward. Table A sets forth an example of a pay table which may be provided for the game. It is to understood that other pay tables as well as patterns could be pre-selected and stored or selected by the player.

TABLE A

| Wager | 1 Unit | 2 Units | 3 Units | 4 Units | 5 Units |
|---|---|---|---|---|---|
| 1 Way | 10 | 20 | 30 | 40 | 50 |
| 2 Way | 20 | 40 | 60 | 80 | 100 |
| 3 Way | 40 | 80 | 120 | 160 | 200 |
| 4 Way | 80 | 160 | 240 | 320 | 400 |
| 5 Way | 100 | 200 | 300 | 400 | 500 |
| 6 Way | 200 | 400 | 600 | 800 | 1000 |
| 7 Way | 400 | 800 | 1200 | 1600 | 2000 |
| 8 Way | 1000 | 2000 | 3000 | 4000 | 5000 |
| 9 Way | 2000 | 4000 | 6000 | 8000 | 10K* |
| 10 Way | 3000 | 6000 | 9000 | 12K | 15K |
| 11 Way | 5K | 10K | 15K | 20K | 25K |
| Cover All** | 10K | 20K | 30K | 40K | Pro*** |

*K = 1000
**From both the first and second outcome sets
***Progressive Jackpot

For Table A, each "way" refers to a winning pattern such as a row, column, diagonal or four corner card obtained by the player. Thus if a player has 2 columns, 2 rows and a diagonal marked upon selection of the first outcome set, he would have a 5 way card and would receive an award based upon Table A. If a player obtains a cover all from the first outcome set alone or with the additional draws of the second outcome set, they would receive an award for the cover all.

It is to be understood that other pay tables could be adopted as well.

After the processor 14 has determined any awards based upon the selection of the first outcome set, the processor randomly selects a second outcome set of a pre-selected number of Bingo numbers (balls). In one embodiment, where the first outcome set is twenty-five indicia, the second outcome set may be ten numbers (balls 42) for a total selection of thirty-five numbers. As with the first outcome set, as the second outcome set is selected, the processor 14 compares the selected indicia (letter/number balls 42) with the columns and numbers of the card 32. If a ball matches a coordinate position number, that coordinate position 34 is marked or indicated. Further the balls 42 selected are displayed in the call board area 44 and are preferably displayed in a different color in the call board area 44 and on the card 32 to distinguish the first and second selection sets. When the selection has been completed, the processor 14 determines whether all of the coordinate positions 34 have been marked representing a cover all for the card 32. If, from the thirty-five letter/number balls 42, all twenty-five coordinate positions 34 have been marked, i.e. the card numbers and column letters can be found on twenty-five balls from the first and second selection set, the player is entitled to a second award.

To provide for a progressive second award, a portion of each wager such as 2½ percent may be allocated to a progressive jackpot. With reference to FIG. 1, to provide even larger jackpots, a plurality of like devices 10 have their processors 14 linked through an Internet, LAN (local area network) or WAN (wide area network) whereupon a portion of the wagers from all linked machines are allocated to a mutual jackpot to be awarded upon the player obtaining a cover all. This progressive may, based upon the odds of obtaining a cover all, start at 50,000 units.

To replay the card 32, the player enters another wager and prompts play. To select a different card 32, the player may prompt erase and make their own selection or prompt the processor to select the numbers for the card 32 coordinate positions 34.

To cash out or receive a pay, the player depresses the cash out button 28 and coins or tokens are dispensed.

If the player is dissatisfied with the balls that are being selected, means are provided for the player to alter the clock setting or position of the RNG. These means may be embodied as a re-spin button 50. Accordingly, if the player has played a card 32 a plurality of times without success, he may feel that the RNG is not timed so as to select a winning outcome and that another RNG clock setting or position may result in the random the selection of a winning outcome. To change the RNG clock position, before prompting play, the player would depress the re-spin button 50 which would either advance or retard the RNG clock and alter the position relative to the data string where the selections are made. This may, in the player's mind, provide them with a better chance of obtaining a winning outcome.

To alter the performance of the game, the number of balls 42 drawn for the first and/or second set may be altered. For example, in another embodiment the first outcome set may be 25 balls 42 with the second outcome set being an additional 28 to 31 balls 42 for totals of between 53 and 56 balls 42. In this embodiment the coverall from the total draw would pay 400 units per unit wagered.

In still another embodiment, the player may receive and award after the draw of the second set for obtaining a coverall as well as one or more a predetermined number of ways, e.g. 5 or more ways.

In still a further embodiment, the player may be afforded the option to place a second wager prior to the second draw of the additional balls 42. For example, the player may make a first wager of 5 units and after the first draw of, for example, 25 balls 42 have obtained a 2-way outcome entitling him to an award of 100 units according to the exemplar pay table of Table A above. The player may then make a second wager and prompt play whereupon the second set of, for example, 10 balls 42 is drawn. Where the second wager is limited to a wager equal to the first wager, (1) the player must have a predetermined outcome such as a 3-Way, 4-Way or better and (2) the award is double the award of Table A. It should be noted that other awards based on the second wager and the draw of the first and second outcome sets could be adopted as well. It should be understood that the second wager could be double the first wager, or less than or more than the first wager.

In one embodiment, the player can make the second wager, i.e. double the wager, and receive and award even in circumstances where the player has a winner from the first outcome set. That is, if the player makes a 5 unit wager and from the first outcome set that player has a 3-Way, he may double down and even if the player does not improve the card by obtaining a higher pay outcome (only has a 3-Way after the first and second outcome sets have been drawn), the player still receives a double award. In the foregoing example, for the 3-Way on the first outcome set the player would be entitled to an award of 200 units from Table A. The player would make the second wager and assuming the outcome os not improved by the draw of the second outcome set, the player would receive and award of 2×200=400 units. If the player improves based upon the second outcome set to a 4-Way he would be paid 2×400=800 units.

In another embodiment, the player receives an award based upon the second wager only if the outcome is improved by the draw of the second outcome set. Thus, in the first example above where the second outcome set does not result in improvement upon a 3-Way obtained from the first outcome set, the player's second wager would be lost and the player would be paid only 200 Units. If the outcome was improved to a 5-Way based upon the draw of the second outcome set the player would be paid 800 units.

Other methods for awarding the player based upon the first and second outcome sets can be considered as well. For example, if the second outcome set improves the 3-Way to a 4-Way, the player would be paid 200 units (3-Way on draw of the first outcome set) and 400 units (4-Way from combined first and second outcome sets from Table A).

As can be appreciated the device and method of play provides the player with several opportunities to win. They may obtain one or more winning patterns from the first outcome set or they may obtain a cover all upon selection of the second outcome set. Further the method and device permits a single player to play Bingo. The player can also select the numbers for their cards 32 and can alter the clock setting for the RNG.

It should also be understood that in any of the foregoing embodiments, the player can play more than one player card, i.e. wager on and enable five player Bingo cards.

While I have described the device and method in connection with a gaming device, it should be understood that the game can be played with linked terminals such as machines linked though a local or wide area network (LAN or WAN) or through the Internet. In such a case, the processor 14 would be located remote from and in communication with player terminals. Players would wager upon and enable one or Bingo cards 32 for play. The numbers for the card(s) may be selected by the processor 32 or by the remote and linked player in the manner described above. The first and second outcome sets could be drawn live using a physical Bingo ball cage, with the drawing broadcast to the player terminals, or the processor may select the sets in the manner described above. The processor would compare the first and second outcome sets to the numbers on player cards and announce/display winners and awards. The awards to players for winning card(s) may be cached at a player account with the casino or issued to the player by known means.

In a Class II embodiment, with a single player playing a device 10 and to assure compliance with the requirement of having a winning card for each game, the processor 14 is configured to establish for each game a plurality of virtual Bingo cards stored in the memory of the processor 14. The player will compete with his one or player Bingo card(s) against these virtual Bingo cards. To assure a winning from the selection of the first and second outcome sets, up to 99 or more virtual Bingo cards can be created by the processor 14 for each game.

Accordingly, the player makes a first wager and enables one or more player Bingo cards. The processor 14 enables a plurality of virtual Bingo cards, e.g. sufficient Bingo cards for the total number of player and virtual Bingo cards to be approximately 100. Since the processor 14 randomly picks the numbers for the coordinates of the virtual Bingo cards, each card will be different. It is believed that by having a total "pool" of about 100 cards, that in the draw there will be at least one winning outcome pattern defining a Bingo.

The processor 14 (or though a live draw) selects the first and second outcome sets. If the player has a winning card with an outcome such as defined in Table A above from the first outcome set, they are issued an appropriate award. Including the first and second outcome sets, the cards are again compared. If the player does not have a winning outcome, e.g. a coverall from the combined sets as described above, they receive no additional award. All winning outcomes occurring in the virtual Bingo cards are displayed for the player to see to confirm that there has been at least one winning outcome from the draw of the first and second outcome sets.

In this embodiment, the player may also have the option of placing a second wager and with the effect as described above. That is if the player has a 3-Way or better, they receive a second award.

In another embodiment, if neither the player or a virtual Bingo card has a winning outcome from the draw of the first and second outcome sets, i.e. a Bingo as defined by at least a 1-Way, the player's wager(s) are, returned to the player.

While I have shown and described certain embodiments of the present invention, it is to be understood that it is subject to many changes and modifications without departing from the spirit and scope of the appended claims. For example, as stated above, the jumping symbol could be any other symbol consistent with the theme and overall presentation of the game.

I claim:

1. An electronic device for conducting a Bingo game comprising:

a data processor;

a display;

means for a player to initiate play of a Bingo game, said processor controlling the display to display a 5×5 Bingo card matrix and at each coordinate of the card a number selected from a universe of Bingo numbers;

a first data structure storing data corresponding to each of a plurality of winning patterns of identified coordinates on said card;

means for the processor to select from the universe of Bingo numbers a preselected quantity of numbers defining a first outcome set and an additional quantity of numbers to represent a second outcome set;

said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award to the player if at least one of said patterns occur on said card and (b) to compare the identified locations from the first and second sets to the patterns stored at the first data structure to determine if at least one predetermined pattern occurs and, if so, issue an award to the player; and means for the player to enter a second wager at least prior to the said processor identification of the coordinate locations of the concordance on the card selection resulting from the selection of said second set of numbers.

2. The device of claim 1 wherein said first data structure includes data corresponding to card patterns of a plurality of one or more columns, rows, diagonals or four corners or a coverall pattern.

3. The device of claim 1 wherein said first outcome set is twenty-five numbers.

4. The device of claim 1 wherein the second outcome set is at least ten numbers.

5. The device of claim 1 wherein the first outcome set is twenty-five numbers and the second outcome set is ten numbers.

6. The device of claim 1 wherein the first outcome set is twenty-five numbers and the second outcome set is between twenty-eight numbers and thirty-one numbers, inclusive.

7. The device of claim 6 further comprising said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award to the player if at least one of said patterns occur on said card and (b) to compare the identified locations from the first and second sets to determine if the player has a coverall and, if so, issue an award to the player.

8. The device of claim 1 further comprising means for the player to enter a first wager and means to prompt the processor to select from the universe of Bingo numbers a pre-selected quantity of numbers defining the first outcome set and an additional pre-selected quantity of numbers to represent the second outcome set and said processor configured to issue any awards based upon said first wager.

9. The device of claim 8 further comprising said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award to the player if at least one of said patterns occur on said card and (b) to compare the identified locations from the first and second sets to determine if the player has a coverall and, if so, issue an award to the player.

10. The device of claim 1 further comprising said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award based upon said first wager to the player if at least one of said patterns occur on said card and (b) to compare the identified locations from the second set to determine if the player has at least one of a predetermined schedule of winning second set patterns and, if so, issue an additional award to the player.

11. The device of claim 10 further comprising said predetermined schedule of second set winning outcomes including any 3-way, 4way or coverall pattern outcomes.

12. The device of claim 1 wherein said processor is programmed to control the display to display each number selected.

13. The device of claim 1 wherein said processor is programmed to control the display to show the first and second outcome sets in different colors.

14. The device of claim 1 further comprising means for the player to select the number for any location on the card matrix from said universe.

15. The device claim 1 further comprising issuing an award based upon the schedule of:

| | 1 Unit | 2 Units | 3 Units | 4 Units | 5 Units |
|---|---|---|---|---|---|
| 1 Way | 10 | 20 | 30 | 40 | 50 |
| 2 Way | 20 | 40 | 60 | 80 | 100 |
| 3 Way | 40 | 80 | 120 | 160 | 200 |
| 4 Way | 80 | 160 | 240 | 320 | 400 |
| 5 Way | 100 | 200 | 300 | 400 | 500 |
| 6 Way | 200 | 400 | 600 | 800 | 1000 |
| 7 Way | 400 | 800 | 1200 | 1600 | 2000 |
| 8 Way | 1000 | 2000 | 3000 | 4000 | 5000 |
| 9 Way | 2000 | 4000 | 6000 | 8000 | 10K* |
| 10 Way | 3000 | 6000 | 9000 | 12K | 15K |
| 11 Way | 5K | 10K | 15K | 20K | 25K |
| Cover All** | 10K | 20K | 30K | 40K | Pro*** |

*K = 1000

**From both the first and second outcome sets

***Progressive Jackpot.

16. The device of claim 1 wherein said processor includes a clock operated random number generator and further comprises means for altering the timing position of the clock.

17. An electronic device for conducting a Bingo game comprising:

a data processor;

a display;

wager input apparatus for a player to input a wager to enable a player Bingo card defining a 5×5 matrix and at each coordinate of the card a number selected from a universe of Bingo numbers;

a first data structure storing data corresponding to each of a plurality of winning patterns of identified coordinates on said card;

means for selecting from the universe of Bingo numbers a pre-selected quantity of numbers defining a first outcome set and an additional quantity of numbers to represent a second outcome set;

said processor programmed (i) to compare said number sets to the numbers of each Bingo card and determine if a concordance occurs to identify the coordinate location of the concordance on the card, (ii) to compare the pattern of identified coordinates from the first outcome set to the patterns stored at the first data structure and to issue an award to the player if at least one of said patterns occur on said card and (iii) to compare the identified locations from the first and second sets to the patterns stored at the first data structure to determine at least one additional pattern occur and, if so, issue an award to the player; and means for the player to enter a second wager at least prior to the said processor identifying of the coordinate locations of the concordance on the card selection resulting from the selection of said second set of numbers.

18. The device of claim 17 wherein said first data structure includes data corresponding to card patterns of a column, four corners, a diagonal, a row and a coverall.

19. The device of claim 17 wherein said first outcome set is twenty-five numbers.

20. The device of claim 17 wherein the second outcome set is at least ten numbers.

21. The device of claim 17 wherein the first outcome set is twenty-five numbers and the second outcome set is ten numbers.

22. The device of claim 17 wherein the first outcome set is twenty-five numbers and the second outcome set is between twenty-eight numbers and thirty-one numbers, inclusive.

23. The device of claim 17 further comprising said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award to the player if at least one of said patterns occur on said card and (b) to compare the identified locations from the first and second sets to determine if the player has a coverall and, if so, issue an award to the player.

24. The device of claim 17 further comprising means for the player to enter a first wager and means to prompt the processor to select from the universe of Bingo numbers a pre-selected quantity of numbers defining the first outcome set and an additional pre-selected quantity of numbers to represent the second outcome set and said processor configured to issue any awards based upon said first wager.

25. The device of claim 17 further comprising said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award to the player if at least one of said patterns occur on said card and (b) to compare the identified locations from the first and second sets to determine if the player has a coverall and, if so, issue an award to the player.

26. The device of claim 17 further comprising said processor programmed (i) to compare said number sets to the numbers of the card and determine if a concordance occurs, (ii) to control the display to identify the coordinate location of the concordance on the card, (iii)(a) to compare the pattern of identified coordinates from the first outcome set to the patterns stored at the first data structure and to issue an award based upon said first wager to the player if at least one of said patterns occur on said card and (b) to compare the identified locations from the first and second sets to determine if the player has at least one of a predetermined schedule of winning second set patterns and, if so, issue an additional award to the player.

27. The device of claim 17 further comprising said predetermined schedule of second set winning outcomes including any 3-way, 4way or coverall pattern outcomes.

28. The device of claim 17 further comprising means for the player to select the number for any location on the card matrix from said universe.

29. The device of claim 17 further comprising issuing an award based the selection of the first outcome set and the schedule of:

| | 1 Unit | 2 Units | 3 Units | 4 Units | 5 Units |
|---|---|---|---|---|---|
| 1 Way | 10 | 20 | 30 | 40 | 50 |
| 2 Way | 20 | 40 | 60 | 80 | 100 |
| 3 Way | 40 | 80 | 120 | 160 | 200 |
| 4 Way | 80 | 160 | 240 | 320 | 400 |
| 5 Way | 100 | 200 | 300 | 400 | 500 |
| 6 Way | 200 | 400 | 600 | 800 | 1000 |
| 7 Way | 400 | 800 | 1200 | 1600 | 2000 |
| 8 Way | 1000 | 2000 | 3000 | 4000 | 5000 |
| 9 Way | 2000 | 4000 | 6000 | 8000 | 10K* |
| 10 Way | 3000 | 6000 | 9000 | 12K | 15K |
| 11 Way | 5K | 10K | 15K | 20K | 25K |
| Cover All** | 10K | 20K | 30K | 40K | Pro*** |

*K = 1000

**From both the first and second outcome sets

Progressive Jackpot.

30. The device of claim 17 wherein said processor includes a clock operated random number generator and further comprises means for altering the timing position of the clock.

31. A method for conducting an electronic Bingo game of the type having an electronic display, the method comprising;

displaying at a player display a Bingo card having a 5×5 matrix of coordinates, each coordinate identified by a discrete Bingo number selected from a universe of Bingo numbers;

receiving a wager from the player to play the game;

randomly selecting from the universe of Bingo numbers a first outcome set of numbers of a pre-selected number and a second outcome set of a numbers;

a processor comparing the outcome sets of numbers to the numbers of the Bingo card and if a concordance exists, indicating the location on the matrix of the concordance;

if the pattern of said indicated locations from selection of the first outcome set corresponds to one or more pre-selected patterns, issuing the player an award;

if the pattern of said indicated locations from selection of the first and second sets corresponds to one or more pre-selected patterns, issuing an award to the player;

receiving a second wager from the player prior to selection of the second outcome set; and if the pattern of said indicated locations from selection of the first and second sets corresponds to one or more pre-selected patterns, issuing an award to the player based upon one of said second or the aggregate of said first and second wagers.

32. The method of claim 31 further comprising selecting twenty-five numbers as the first outcome set.

33. The method of claim 32 further comprising selecting ten numbers as the second outcome set.

34. The method of claim 31 further comprising selecting twenty-five numbers as the first outcome set and ten numbers as the second outcome set.

35. The method of claim 31 further comprising selecting the pre-selected pattern from a pattern on the matrix of a row, column, diagonal, four corners and coverall.

36. The method of claim 31 further comprising selecting twenty-five numbers as the first outcome set and an additional twenty-eight numbers to thirty-one numbers, inclusive, as the second outcome set.

* * * * *